US009007049B2

(12) United States Patent
Huang

(10) Patent No.: US 9,007,049 B2
(45) Date of Patent: Apr. 14, 2015

(54) CURRENT SOURCE CIRCUIT WITH TEMPERATURE COMPENSATION

(71) Applicant: IPGoal Microelectronics (Sichuan) Co., Ltd, Chengdu, Sichuan (CN)

(72) Inventor: Junwei Huang, Sichuan (CN)

(73) Assignee: IPGoal Microelectronics (Sichuan) Co., Ltd., Chengdu, Sichuan Province (CN)

( * ) Notice: Subject to any disclaimer, the term of this patent is extended or adjusted under 35 U.S.C. 154(b) by 69 days.

(21) Appl. No.: 13/857,521

(22) Filed: Apr. 5, 2013

(65) Prior Publication Data

US 2013/0265019 A1 Oct. 10, 2013

(30) Foreign Application Priority Data

Apr. 5, 2012 (CN) ..... 2012 1 0097869

(51) Int. Cl.
*G05F 3/16* (2006.01)
*G05F 3/20* (2006.01)
*G05F 1/46* (2006.01)

(52) U.S. Cl.
CPC ..... *G05F 1/463* (2013.01)

(58) Field of Classification Search
USPC ..... 323/313; 327/541
See application file for complete search history.

(56) References Cited

U.S. PATENT DOCUMENTS

| | | | | |
|---|---|---|---|---|
| 5,900,773 | A * | 5/1999 | Susak | 323/313 |
| 6,107,868 | A * | 8/2000 | Diniz et al. | 327/543 |
| 6,788,041 | B2 * | 9/2004 | Gheorghe et al. | 323/313 |
| 7,075,282 | B2 * | 7/2006 | Feng | 323/313 |
| 7,808,068 | B2 * | 10/2010 | Hartley | 257/467 |
| 2008/0018317 | A1 * | 1/2008 | Chen et al. | 323/313 |

* cited by examiner

*Primary Examiner* — Jue Zhang

(57) ABSTRACT

A current source circuit with temperature compensation includes a power supply terminal, a reference current source unit connected to the power supply terminal, a feedback control unit connected to the power supply terminal and the reference current source unit, a current source generating unit connected to the feedback control unit and a ground terminal connected to the current source generating unit. The reference current source unit is a current source connected to the power supply terminal. The feedback control unit includes a first switching element, connected to the current source, and an inverting amplifier, connected between the current source and the first switching element. The current source generating unit includes a second switching element, connected to the first switching element, the current source and the inverting amplifier, and a first resistor, connected to the first and the second switching elements and the ground terminal.

2 Claims, 2 Drawing Sheets

CURRENT SOURCE CIRCUIT WITH TEMPERATURE COMPENSATION

BACKGROUND OF THE PRESENT INVENTION

1. Field of Invention

The present invention relates to a current source circuit, and more particularly to a current source circuit with a simple structure and temperature compensation.

2. Description of Related Arts

The current source is an indispensable module for the analog integrated circuit. Usually via dividing a voltage by a resistance, the value of the current source is obtained, but also contains a relatively big temperature coefficient. However, some current source circuits under special temperature processing have complex structures and take up a relatively large area.

In order to obtain a possibly small change of the current source caused by the temperature thereof, it is necessary to provide a current source circuit with a simple structure and temperature compensation.

SUMMARY OF THE PRESENT INVENTION

According to the above illustration, it is necessary to provide a current source circuit with a simple structure and temperature compensation.

The present invention provides a current source circuit with temperature compensation which comprises a power supply terminal, a reference current source unit connected to the power supply terminal, a feedback control unit connected to the power supply terminal and the reference current source unit, a current source generating unit connected to the feedback control unit, and a ground terminal connected to the current source generating unit. The reference current source unit is a current source connected to the power supply terminal. The feedback control unit comprises a first switching element, connected to a first terminal of the current source, and an inverting amplifier, connected between a second terminal of the current source and the first switching element. The current source generating unit comprises a second switching element, connected to the first switching element, the current source and the inverting amplifier, and a first resistor, connected to the first switching element, the second switching element and the ground terminal.

The present invention also provides a current source circuit with temperature compensation which comprises a power supply terminal, a reference current source unit connected to the power supply terminal, a feedback control unit connected to the power supply terminal and the reference current source unit, a current source generating unit connected to the feedback control unit, and a ground terminal connected to the current source generating unit. The reference current source unit is a current source connected to the power supply terminal. The feedback control unit comprises a tenth switching element, an eleventh switching element connected between the tenth switching element and the power supply terminal, and a buffer connected to the tenth switching element. The current source generating unit comprises a twelfth switching element, connected between the tenth switching element and the buffer, and a connecting resistor, connected to the tenth switching element and the twelfth switching element.

Compared to the prior arts, the current source circuit with temperature compensation of the present invention is capable of effectively compensating a temperature coefficient of the generated current source only by setting the switching element, which is accomplished via a simple structure and an easy manner.

These and other objectives, features, and advantages of the present invention will become apparent from the following detailed description, the accompanying drawings, and the appended claims.

DETAILED DESCRIPTION OF THE PREFERRED EMBODIMENT

Figure 1:
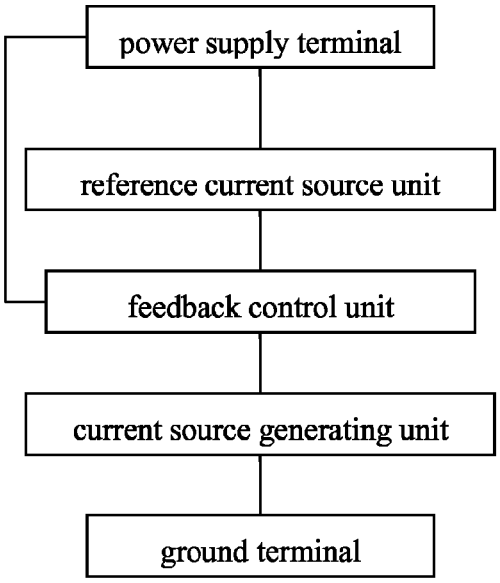
FIG. 1 is a block diagram of a current source circuit with temperature compensation according to a first preferred embodiment of the present invention.

Referring to FIG. 1 of the drawings, according to a first preferred embodiment of the present invention, a current source circuit with temperature compensation comprises a power terminal, a reference current source unit connected to the power terminal, a feedback control unit connected to the power terminal and the reference current source unit, a current source generating unit connected to the feedback control unit, and a ground terminal connected to the current source generating unit.

Figure 2:
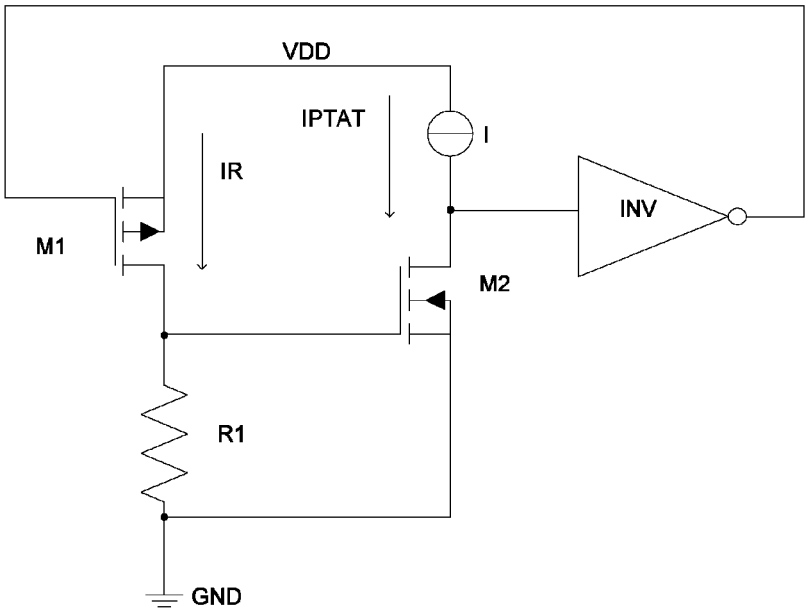
FIG. 2 is a sketch view of a circuit diagram of the current source circuit with temperature compensation according to the first preferred embodiment of the present invention.

Referring to FIG. 2, a circuit diagram of the current source circuit with temperature compensation according to the first preferred embodiment of the present invention is showed, wherein the power supply terminal is a power supply terminal VDD; the reference current source unit is a current source I; the feedback control unit comprises a first switching element and an inverting amplifier INV; the current source generating unit comprises a second switching element and a first resistor R1; the ground terminal is a ground terminal GND. According to the first preferred embodiment of the present invention, the first switching element is a first field effect transistor (FET) M1, and the second switching element is a second FET M2; further, the first FET M1 is a PMOS and the second FET M2 is an NMOS. The switching elements according to other preferred embodiments of the present invention can be other type of switching elements or circuits capable of accomplishing identical functions.

The circuit diagram according to the first preferred embodiment has following circuit connections. A gate electrode of the first FET M1 is connected to an output terminal of the inverting amplifier INV; a source electrode of the first FET M1 and a first terminal of the current source I are both connected to the power supply terminal VDD; a drain electrode of the first FET M1 is connected to a first terminal of the first resistor R1 and a gate electrode of the second FET M2; a drain electrode of the second FET M2 and a second terminal of the current source I are both connected to an input terminal of the inverting amplifier INV; and a second terminal of the first resistor R1 and a source electrode of the second FET M2 are both connected to the ground terminal GND.

Figure 3:
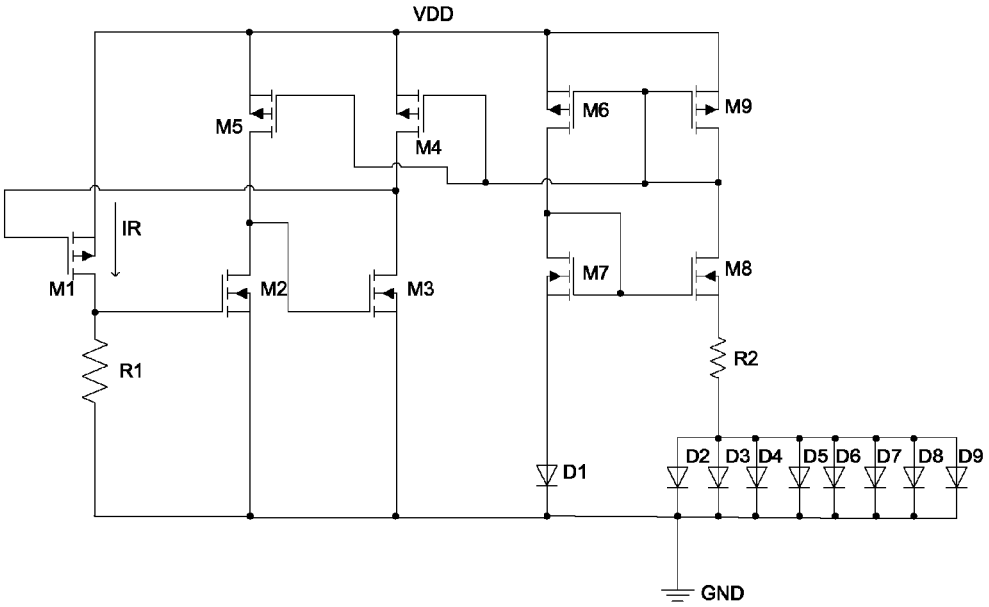
FIG. 3 is a sketch view of a specific circuit diagram of the current source circuit with temperature compensation according to the first preferred embodiment of the present invention.

Further referring to FIG. 3, a specific circuit diagram of the current source circuit with temperature compensation according to the first preferred embodiment of the present invention is showed, wherein the inverting amplifier INV comprises a third FET M3 and a fourth FET M4; the current source I comprises a fifth FET M5, a sixth FET M6, a seventh FET M7, an eighth FET M8, a ninth FET M9, a second resistor R2, a first diode D1, a second diode D2, a third diode D3, a fourth diode D4, a fifth diode D5, a sixth diode D6, a seventh diode D7, an eighth diode D8 and a ninth diode D9.

The specific circuit diagram according to the first preferred embodiment has following connections. A gate electrode of the first FET M1 is connected to a drain electrode of the third FET M3 and a drain electrode of the fourth FET M4; a drain electrode of the first FET M1 is connected to a first terminal of the first resistor R1 and a gate electrode of the second FET M2. A drain electrode of the second FET M2 and a drain electrode of the fifth FET M5 are both connected to a gate electrode of the third FET M3; and a gate electrode of the fifth FET M5, a gate electrode of the sixth FET M6, a drain electrode of the eighth FET M8 and a gate electrode and a drain electrode of the ninth FET M9 are all connected to a gate electrode of the fourth FET M4. A drain electrode of the sixth FET M6 and a gate electrode and a drain electrode of the seventh FET M7 are all connected to a gate electrode of the eighth FET M8; a source electrode of the seventh FET M7 is connected to an input terminal of the first diode D1; and a source electrode of the eight FET M8 is connected to a first terminal of the second resistor R2. An input terminal of the second diode D2, an input terminal of the third diode D3, an input terminal of the fourth diode D4, an input terminal of the fifth diode D5, an input terminal of the sixth diode D6, an input terminal of the seventh diode D7, an input terminal of the eighth diode D8 and an input terminal of the ninth diode D9 are all connected to a second terminal of the second resistor R2. A source electrode of the first FET M1, a source electrode of the fourth FET M4, a source electrode of the fifth FET M5, a source electrode of the sixth FET M6 and a source electrode of the ninth FET M9 are all connected to the power supply terminal VDD; and a second terminal of the first resistor R1, a source electrode of the second FET M2, a source electrode of the third FET M3, an output terminal of the first diode D1, an output terminal of the second diode D2, an output terminal of the third diode D3, an output terminal of the fourth diode D4, an output terminal of the fifth diode D5, an output terminal of the sixth diode D6, an output terminal of the seventh diode D7, an output terminal of the eighth diode D8 and an output terminal of the ninth diode D9 are all connected to the ground terminal GND.

According to the first preferred embodiment of the present invention, the current source circuit with temperature compensation has following working principles. As showed in FIGS. 2 and 3, a current IR runs through the first FET M1. After the current IR runs through the first resistor R1, a drive voltage is generated for driving the second FET M2 to work, in such a manner that the current running through the second FET M2 is equal to a positive temperature coefficient current IPTAT running through the current source I; the drain electrode of the second FET M2 drives the gate electrode of the third FET M3 in the inverting amplifier INV, and the output terminal of the inverting amplifier INV outputs a controlling signal for controlling the gate electrode of the first FET M1, so as to form a feedback loop.

Via the feedback loop, a value of the current IR is counted as follows:

$$IR=((2*IPTAT*L/(\mu n*Cox*W))^{0.5}+VTH)/R1, \text{ wherein}$$

L is a channel length of the second FET M2; W is a channel width of the second FET M2; μn is an electron mobility; Cox is a gate-oxide capacitance; VTH is a threshold voltage of the second FET M2. Further, IPTAT is the positive temperature coefficient current value and μn is a negative temperature coefficient electron mobility, so a value of IPTAT/μn is of positive temperature coefficient. Since a value of VTH is of negative temperature coefficient, the temperature coefficient of the current IR in the above equation is effectively compensated only by setting the value of L/W.

Figure 4:
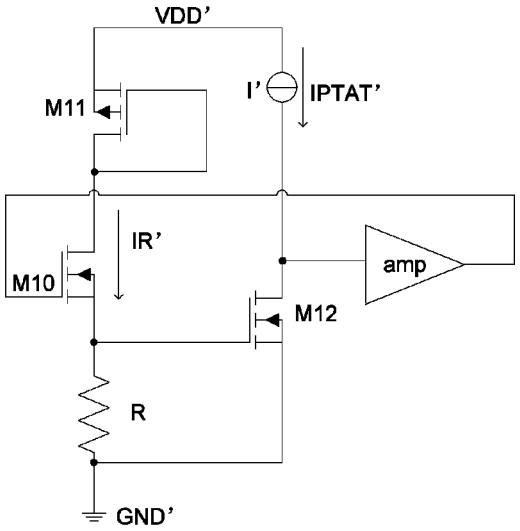
FIG. 4 is a sketch view of the circuit diagram of the current source circuit with temperature compensation according to a second preferred embodiment of the present invention.

Referring to FIG. 4, the circuit diagram of the current source circuit with temperature compensation according to a second preferred embodiment of the present invention is showed, wherein the power supply terminal is a power supply terminal VDD'; the reference current source unit is a current source I'; the feedback control unit comprises a tenth switching element, an eleventh switching element and a buffer amp; the current source generating unit comprises a twelfth switching element and a connecting resistor R; and the ground terminal is a ground terminal GDN'. According to the second preferred embodiment of the present invention, the tenth switching element is a tenth FET M10; the eleventh switching element is an eleventh FET M11; the twelfth switching element is a twelfth FET M12. Further, the tenth FET M10 is an NMOS; the eleventh FET M11 is a PMOS; and the twelfth FET M12 is an NMOS. The switching elements can be other type of switching elements or circuits capable of accomplishing identical functions in other preferred embodiments.

The circuit diagram according to the second preferred embodiment has following circuit connections. A gate electrode of the tenth FET M10 is connected to an output terminal of the buffer amp; a source electrode of the tenth FET M10 is connected to a first terminal of the connecting resistor R and a gate electrode of the twelfth FET M12; a drain electrode of the tenth FET M10 is connected to a gate electrode and a drain electrode of the eleventh FET M11; a source electrode of the eleventh FET M11 and a first terminal of the current source I' are both connected to the power supply terminal VDD'; a drain electrode of the twelfth FET M12 and a second terminal of the current source I' are both connected to an input terminal of the buffer amp; and a second terminal of the connecting resistor R and a source electrode of the twelfth FET M12 are both connected to the ground terminal GND'.

The circuit diagram according to the second preferred embodiment has following working principles. As showed in FIG. 4, a current IR' runs through the tenth FET M10; after the current IR' runs through the connecting resistor R, a drive voltage is generated for driving the twelfth FET M12 to work, in such a manner that the current running through the twelfth FET M12 is equal to a positive temperature coefficient current IPTAT' running through the current source I'; the drain electrode of the twelfth FET M12 drives the buffer amp and the output terminal of the buffer amp outputs a controlling signal for controlling the gate electrode of the tenth FET M10, so as to form a feedback loop. The current IR' determined by the feedback loop mirrors via the eleventh FET M11 and is available for output.

Via the feedback loop, a value of the current IR' is counted as follows:

$$IR'=((2*IPTAT'*L'/\mu n'*Cox'*W'))^{0.5}+VTH')/R, \text{ wherein}$$

L' is a channel length of the twelfth FET M12; W' is a channel width of the twelfth FET M12; μn' is an electron mobility; Cox' is a gate-oxide capacitance; VTH' is a threshold voltage of the twelfth FET M12. Further, IPTAT' is the positive temperature coefficient current value and μn' is a negative temperature coefficient electron mobility, so a value of IPTAT'/μn' is of positive temperature coefficient. Since a value of VTH' is of negative temperature coefficient, the temperature coefficient of the current IR' in the above equation is effectively compensated only by setting the value of L'/W'.

The current source circuit with temperature compensation of the present invention has a simple structure and is capable of effectively compensating the temperature coefficient of the generated current source only by setting a related ratio of the switching element.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A current source circuit with temperature compensation, comprising:

a power supply terminal;

a reference current source unit connected to said power supply terminal;

a feedback control unit connected to said power supply terminal and said reference current source unit;

a current source generating unit connected to said feedback control unit; and a ground terminal connected to said current source generating unit;

wherein said reference current source unit is a current source connected to said power supply terminal;

said feedback control unit comprises a first switching element, connected to a first terminal of said current source, and an inverting amplifier, connected between a second terminal of said current source and said first switching element; and said current source generating unit comprises a second switching element which is connected to said first switching element, said current source and said inverting amplifier, and a first resistor which is connected to said first switching element, said second switching element and said ground terminal;

wherein said first switching element is a first field effect transistor (FET) and said second switching element is a second FET, wherein further said first FET is a PMOS and said second FET is an NMOS;

wherein said inverting amplifier comprises a third FET which is connected to said second FET, and a fourth FET which is connected to said third FET;

a gate electrode of said first FET is connected to a drain electrode of said third FET and a drain electrode of said fourth FET; and a drain electrode of said first FET is connected to a first terminal of said first resistor and a gate electrode of said second FET; and wherein said current source comprises a fifth FET, a sixth FET, a seventh FET, an eighth FET, a ninth FET, a second resistor, a first diode, a second diode, a third diode, a fourth diode, a fifth diode, a sixth diode, a seventh diode, an eighth diode and a ninth diode;

a drain electrode of said second FET and a drain electrode of said fifth FET are both connected to a gate electrode of said third FET;

a gate electrode of said fifth FET, a gate electrode of said sixth FET, a drain electrode of said eighth FET and a gate electrode and a drain electrode of said ninth FET are all connected to a gate electrode of said fourth FET;

a drain electrode of said sixth FET and a gate electrode and a drain electrode of said seventh FET are all connected a gate electrode of said eighth FET;

a source electrode of said seventh FET is connected to an input terminal of said first diode;

a source electrode of said eighth FET is connected to a first terminal of said second resistor; and an input terminal of said second diode, an input terminal of said third diode, an input terminal of said fourth diode, an input terminal of said fifth diode, an input terminal of said sixth diode, an input terminal of said seventh diode, an input terminal of said eighth diode and an input terminal of said ninth diode are all connected to a second terminal of said second resistor.

2. The current source circuit with temperature compensation, as recited in claim 1, wherein a source electrode of said first FET, a source electrode of said fourth FET, a source electrode of said fifth FET, a source electrode of said sixth FET and a source electrode of said ninth FET are all connected to said power supply terminal; and a second terminal of said first resistor, a source electrode of said second FET, a source electrode of said third FET, an output terminal of said first diode, an output terminal of said second diode, an output terminal of said third diode, an output terminal of said fourth diode, an output terminal of said fifth diode, an output terminal of said sixth diode, an output terminal of said seventh diode, an output terminal of said eighth diode and an output terminal of said ninth diode are all connected to said ground terminal.

* * * * *